US005656042A

United States Patent [19]

Khan et al.

[11] Patent Number: 5,656,042

[45] Date of Patent: Aug. 12, 1997

[54] ENVIRONMENTALLY ACCEPTABLE PROCESS FOR DISPOSING OF SCRAP PLASTIC MATERIALS

[75] Inventors: Motasimur Rashid Khan, Wappingers Falls; Christine Cornelia Albert, Peekskill, both of N.Y.; John Saunders Stevenson, Los Angeles; George Neal Richter, San Marino, both of Calif.; David Charles Crikelair, Armonk, N.Y.

[73] Assignee: Texaco Inc., White Plains, N.Y.

[21] Appl. No.: 248,622

[22] Filed: May 24, 1994

Related U.S. Application Data

[63] Continuation of Ser. No. 965,104, Oct. 22, 1992, abandoned.

[51] Int. Cl.[6] ..... C10J 3/46

[52] U.S. Cl. ..... 48/197 R; 48/197 A; 48/202; 48/206; 48/DIG. 7

[58] Field of Search ..... 48/197 R, 197 A, 48/202, 206, 209, 210, DIG. 2, DIG. 7; 252/373; 44/280, 281, 282, 605, 628; 588/208, 209, 213, 214

[56] References Cited

U.S. PATENT DOCUMENTS

| | | | |
|---|---|---|---|
| T104,901 | 12/1984 | Cox et al. | 588/208 |
| 3,607,156 | 9/1971 | Schlinger et al. | 48/206 |
| 3,671,209 | 6/1972 | Teichman et al. | 48/209 |
| 3,687,646 | 8/1972 | Brat et al. | 48/209 |
| 3,843,339 | 10/1974 | Saito | 48/209 |
| 4,074,981 | 2/1978 | Slater | 48/197 R |
| 4,225,457 | 9/1980 | Schulz | 48/209 |
| 4,440,543 | 4/1984 | Echtler | 44/282 |
| 4,443,230 | 4/1984 | Stellaccio | 48/DIG. 7 |
| 4,468,376 | 8/1984 | Sugitt | 588/213 |
| 4,655,792 | 4/1987 | Kessler et al. | 48/197 R |
| 4,666,462 | 5/1987 | Martin | 48/DIG. 7 |
| 4,705,535 | 11/1987 | Lipp | 48/DIG. 7 |
| 4,705,538 | 11/1987 | Najjar et al. | 48/DIG. 7 |
| 4,789,384 | 12/1988 | Martens et al. | 48/197 R |
| 4,875,906 | 10/1989 | Apel | 48/DIG. 7 |
| 4,888,301 | 12/1989 | Martens | 48/197 R |
| 4,933,086 | 6/1990 | McMahon et al. | 210/603 |
| 5,074,890 | 12/1991 | Schulz | 48/209 |
| 5,188,739 | 2/1993 | Khan et al. | 48/197 A |
| 5,232,487 | 8/1993 | Rabe et al. | 75/414 |
| 5,271,340 | 12/1993 | Whitney | 110/396 |

FOREIGN PATENT DOCUMENTS

| | | | |
|---|---|---|---|
| 0088194 | 9/1983 | European Pat. Off. . | |
| 3333187 | 3/1984 | Germany | 48/210 |
| 3307938 | 9/1984 | Germany | 48/197 R |
| 4017089 | 11/1991 | Germany . | |
| 4104252 | 8/1992 | Germany . | |
| 410923A1 | 9/1992 | Germany . | |
| 4125517 | 10/1992 | Germany . | |
| 53-207 | 1/1978 | Japan | 48/209 |
| 57-153092 | 9/1982 | Japan | 44/280 |

*Primary Examiner*—Timothy McMahon
*Attorney, Agent, or Firm*—Henry H. Gibson

[57] ABSTRACT

A pumpable slurry of shredded scrap solid carbonaceous plastic-containing material that contains associated inorganic matter in admixture with a comminuted aluminosilicate-containing material having noncombustible constituents is reacted by partial oxidation to produce synthesis gas, reducing gas, or fuel gas. The noncombustible constituents in the aluminosilicate-containing material captures the inorganic matter in the scrap solid carbonaceous plastic-containing material while in the reducing atmosphere of the gasifier to produce nontoxic, nonleachable slag. The slurrying medium is water, liquid hydrocarbonaceous fuel, or mixtures thereof. Scrap plastics may be disposed of by the subject process without polluting the nation's environment.

12 Claims, No Drawings

ENVIRONMENTALLY ACCEPTABLE PROCESS FOR DISPOSING OF SCRAP PLASTIC MATERIALS

This application is a continuation of application Ser. No. 07/965,104, filed Oct. 22, 1992, now abandoned.

FIELD OF THE INVENTION

This invention relates to an environmentally safe method for disposing of scrap plastic materials. More particularly, it pertains to a process for the partial oxidation of a pumpable slurry of shredded scrap solid carbonaceous plastic-containing material that contains associated inorganic matter in admixture with a comminuted aluminosilicate-containing material having noncombustible constituents. The liquid slurrying medium may be water and/or liquid hydrocarbonaceous fuel. The inorganic matter in the solid carbonaceous plastic-containing material is safely captured by the noncombustible constituents in the aluminosilicate-containing material to produce nonhazardous slag.

Scrap plastics are solid organic polymers and are available in such forms as sheets, extruded shapes, moldings, reinforced plastics, laminates, and foamed plastics. About 60 billion pounds of plastics are sold in the United States each year. A large part of these plastic materials wind up as scrap plastics in landfills. Although plastics account for only a small portion of the waste dumped in landfills i.e. about 7 wt. % and about 20 percent by volume, burying them is getting increasingly difficult. Landfills are not universally viewed as an acceptable, or even a tolerable option for disposal of plastic materials. Due to the combined effects of the unpopularity of existing facilities and the need for land to allow normal growth of populations, new landfills have been all but banned in many parts of the world. Existing facilities are also facing finite limits as to how long they may continue to function. Further, on-site burning or incineration which are alternative disposal methods are in disfavor because they generate heavy air pollution from noxious gases and soot. With respect to recycling plastics, it has been economically feasible to recycle only about 1 wt. % of the scrap plastics. It is obvious from the aforesaid that the disposal of scrap plastics is one of the nation's most pressing environmental problems.

SUMMARY OF THE INVENTION

This invention relates to an environmentally acceptable process for disposing of scrap plastic materials comprising:

(1) mixing together the following materials to produce a pumpable slurry having a minimum higher heating value (HHV) of about 4500 BTU/lb of slurry:
   (a) solid carbonaceous plastic-containing material that contains associated inorganic matter;
   (b) aluminosilicate-containing material having noncombustible constituents that have an ash fusion temperature in a reducing atmosphere of less than about 2400° F.;
   (c) a liquid slurrying medium selected from the group consisting of water, liquid hydrocarbonaceous fuel, and mixtures thereof; and (2) reacting said pumpable slurry from (1) with a free-oxygen containing gas and with or without a supplemental temperature moderator in a partial oxidation gas generator in a reducing atmosphere to produce synthesis gas, reducing gas, or fuel gas, and nonhazardous slag.

DESCRIPTION OF THE INVENTION

Scrap plastics are disposed of by the process of the subject invention without polluting the nation's environment. In one embodiment, troublesome coal ash resulting from the complete combustion of coal in a power plant is simultaneously disposed of by means of the subject environmentally acceptable process. Simultaneously, useful by-product nonpolluting synthesis gas, reducing gas, fuel gas and nonhazardous slag are produced. In addition, profitable by-product steam and hot water for use in the process or export are produced.

The scrap plastic materials which are used as feed in the subject process as fuel to a partial oxidation gas generator include at least one solid carbonaceous thermoplastic or thermosetting material that contains associated inorganic matter. Sulfur is also commonly found in scrap plastics. Scrap plastic materials may be derived from obsolete equipment, household containers, packaging, industrial sources and junked automobiles. The mixture of plastics is of varying age and composition. With the presence of varying amounts of incombustible inorganic matter compounded in the plastic as fillers, catalysts, pigments and reinforcing agents, recovery of the plastic material is generally impractical. Further, complete combustion can release toxic-noxious components including volatile metals and hydrogen halides. Associated inorganic matter in the scrap solid carbonaceous plastic includes fillers such as titania, talc, clays, alumina, barium sulfate and barium carbonate. Catalysts and accelerators for thermosetting plastics include tin compounds for polyurethanes, and cobalt and manganese compounds for polyesters. Dyes and pigments such as compounds of cadmium, chromium, cobalt, and copper; nonferrous metals such as aluminum and copper in plastic coated wire cuttings; metal films; woven and nonwoven glass and boron reinforcing agents; steel, brass, and nickel metal inserts; and lead compounds from plastic automotive batteries. The inorganic constituents are present in the solid carbonaceous plastic-containing material in the amount of about a trace amount to about 80 wt. % of said solid carbonaceous plastic-containing material, such as about 0.1 to 60 wt. %, say about 1 to 20 wt. % of the plastic-containing material. The scrap plastic material is in the form of sheets, extruded shapes, moldings, reinforced plastics, and foamed plastics.

In the subject process, a pumpable slurry is prepared having a total solids content in the range of about 10 to 70 wt. % when the slurrying medium comprises a liquid hydrocarbonaceous fuel; about 30 to 70 wt. % when the slurrying medium comprises water; and about 25 to 70wt. % when the slurrying medium comprises a mixture of water and liquid hydrocarbonaceous fuel. The solids in the pumpable slurry includes solid carbonaceous plastic-containing material that contains associated inorganic matter and aluminosilicate-containing material having noncombustible constituents. A minimum of 5 wt. % of the total solids in the pumpable slurry is solid carbonaceous plastic-containing material that contains associated inorganic matter. The remainder of the solids in the pumpable slurry substantially comprises said aluminosilicate-containing material having noncombustible constituents. The pumpable slurry is introduced into a partial oxidation gas generator where reaction takes place, with or without, a supplemental temperature moderator.

By definition, the term liquid hydrocarbonaceous fuel as used herein to describe suitable liquid carriers and fuels is selected from the group consisting of liquefied petroleum gas, petroleum distillates and residues, gasoline, naphtha, kerosine, crude petroleum, asphalt, gas oil, residual oil, tar sand oil and shale oil, coal derived oil, aromatic hydrocarbons (such as benzene, toluene, xylene fractions), coal tar, cycle gas oil from fluid-catalytic-cracking operation, furfural extract of coker gas oil, oxygen-containing liquid hydrocarbonaceous organic materials including cellulosic materials and alcohols, and mixtures thereof. Waste motor oil may also be used as a liquid carrier.

In one embodiment, a pumpable slurry having two categories of solid carbonaceous plastic material and a solids content in the range of about 25 to 70 wt. % is fed to the partial oxidation gas generator. About 10 to 95 wt. %, such as about 25 to 75wt. % of the solid carbonaceous plastic material comprises solid carbonaceous plastic-containing material that contains associated inorganic matter. The remainder of the solid carbonaceous plastic materials comprising about 90 to 5 wt. %, such as about 75 to 25 wt. % of the total solid carbonaceous plastic-containing material comprises solid carbonaceous plastic material that is substantially free from associated inorganic matter. The term "substantially free" means that the inorganic matter is less than 0.01 wt. % of the solid carbonaceous plastic-containing material. The expression "A and/or B" is used herein in its usual manner and means A or B or A and B.

Table A gives a breakdown of 1991 sales in the United States of solid carbonaceous plastics.

Figure 1

| Material | Million lbs. 1991 |
|---|---|
| Acrylobutadienestyrene (ABS) | 1,125 |
| Acrylic | 672 |
| Alkyd | 315 |
| Cellulosic | 840 |
| Epoxy | 428 |
| Nylon | 536 |
| Phenolic | 2,556 |
| Polyacetal | 140 |
| Polycarbonate | 601 |
| Polyester, thermoplastic | 2,549 |
| Polyester, unsaturated | 1,081 |
| Polyethylene, high density | 9,193 |
| Polyethylene, low density | 12,143 |
| Polyphenylene-based alloys | 195 |
| Polypropylene and copolymers | 8,155 |
| Polystyrene | 4,877 |
| Other styrenes | 1,180 |
| Polyurethane | 2,985 |
| Polyvinylchloride and copolymers | 9,130 |
| Other vinyls | 120 |
| Styrene acrylonitrile (SAN) | 117 |
| Thermoplastic elastomers | 584 |
| Urea and melamine | 1,467 |
| Others | 345 |
| Total | 60,598 |

The aluminosilicate-containing material that is used as a feedstream in the process is a nonpolymeric material selected from the group of solid materials consisting of coal, associated coal residues such as mine tailings, coal ash, clay (such as illite), and volcanic ash. About 5 to 100 wt. % of the aluminosilicate-containing material comprises inorganic noncombustible constituents. This mixture of constituents has an ash fusion temperature in a reducing atmosphere, such as that in the partial oxidation gas generator, of less than about 2400° F. Any remainder comprises carbonaceous material. Any type of coal may be used as the aluminosilicate-containing material including anthracite, bituminous, sub-bituminous, and lignite. The inorganic constituents in coal substantially comprises aluminosilicate clay materials (illite, smectite, kaolinite), sulfides (pyrite, pyrrhotite), carbonates (calcite, dolomite, siderite), and oxides (quartz, magnetite, rutile, hematite). The mole ratio $SiO_2/Al_2O_3$ in the aluminosilicate-containing material is in the range of about 1.5/1 to 20/1. Further, the total moles of oxides selected from the group consisting of Na, K, Mg, Ca, Fe, and mixtures thereof is about 0.9 to 3 times the moles of $Al_2O_3$. In one embodiment, the composition of the aluminosilicate can be represented as $(Na_2O, K_2O, MgO, CaO, FeO)_x \cdot Al_2O_3 \cdot (SiO_2)_y$ where x is from 0.9 to 3 and y is from 1.5 to 20. The total amount of alumina, silica, and the oxides of Na, K, Mg, Ca and Fe constitutes at least 90 wt. % of the total noncombustible inorganic components.

The solid carbonaceous plastic-containing material that contains associated inorganic matter has a higher heating value (HHV) in the range of about 3000 to 19,000 BTU per lb of solid carbonaceous plastic-containing material. The plastic-containing material is shredded by conventional means to a maximum particle dimension of about ¼", such as about ⅛". Shredding is the preferred method for reducing the size of plastic. Grinding is less effective and more energy intensive. The aluminosilicate-containing material having noncombustible constituents that have an ash fusion temperature in a reducing atmosphere of less than about 2400° F. has a higher heating value (HHV) in the range of about 0 to 15,000 BTU per lb. of aluminosilicate-containing material. The aluminosilicate-containing material is ground by conventional means to a particle size so that 100% passes through ASTM E 11-70 Standard Sieve Designation 1.70 mm (Alternative No. 12). The shredded solid carbonaceous plastic-containing material and the aluminosilicate-containing material are mixed together with a liquid slurrying medium selected from the group consisting of water, liquid hydrocarbonaceous fuel, and mixtures thereof to produce a pumpable slurry having a minimum higher heating value (HHV) of about 4500 BTU/lb. of slurry.

The weight ratio of the noncombustible constituents in the aluminosilicate-containing material to the associated inorganic matter in said solid carbonaceous plastic-containing material is at least 1:1 and preferably at least 3:1.

A suitable surfactant may be introduced into an aqueous slurry of solid carbonaceous plastic-containing material that contains associated inorganic matter and aluminosilicate-containing material having noncombustible constituents in order to increase the slurryability, pumpability, and solids content. About 0.01 to 3.0 wt. %, such as about 0.1 to 2.0 wt. % of ammonium lignosulfonate has been found to be effective. This surfactant is manufactured and marketed under the trademark of ORZAN A, by Crown Zellerbach Corp., Chemical Products Division, Vancouver, Washington.

The slurry of scrap solid carbonaceous plastic-containing material and aluminosilicate-containing material and a stream of free-oxygen containing gas are introduced into the reaction zone of a free-flow unobstructed downflowing vertical refractory lined steel wall pressure vessel where the partial oxidation reaction takes place. A typical gas generator is shown and described in coassigned U.S. Pat. No. 3,544,291, which is incorporated herein by reference.

A two, three or four stream annular type burner, such as shown and described in coassigned U.S. Pat. Nos. 3,847,564, and 4,525,175, which are incorporated herein by reference, may be used to introduce the feedstreams into the partial oxidation gas generator. With respect to U.S. Pat. No. 3,847,564, free-oxygen containing gas may be simultaneously passed through the central conduit 18 and outer annular passage 14 of said burner. The free-oxygen containing gas is selected from the group consisting of substantially pure oxygen i.e. greater than 95 mole % $O_2$, oxygen-riched air i.e. greater than 21 mole % $O_2$, and air. The free-oxygen containing gas is supplied at a temperature in the range of about 100° F. to 1000° F. The slurry of scrap solid carbonaceous plastic-containing material and aluminosilicate-containing material is passed through the intermediate annular passage 16 at a temperature in the range of about ambient to 650° F.

The burner assembly is inserted downward through a top inlet port of the noncatalytic synthesis gas generator. The burner extends along the central longitudinal axis of the gas generator with the downstream end discharging a multiphase mixture of fuel, free-oxygen containing gas, and optionally a temperature moderator such as water or steam directly into the reaction zone. In the case of an aqueous slurry, the temperature moderator may be unnecessary.

The relative proportions of fuels, water and oxygen in the feedstreams to the gas generator are carefully regulated to convert a substantial portion of the carbon in the slurry, e.g., up to about 90% or more by weight, to carbon oxides; and to maintain an autogenous reaction zone temperature in the range of about 1800° F. to 3500° F. Preferably the temperature in the gasifier is in the range of about 2400° F. to 2800° F., so that molten slag is produced. Further, the weight ratio of $H_2O$ to carbon in the feed is in the range of about 0.2 to 3.0, such as about 0.5 to 2.0. The atomic ratio of free-oxygen to carbon in the feed is in the range of about 0.8 to 1.4, such as about 0.9 to 1.2. By the aforesaid operating conditions, a reducing atmosphere comprising $H_2$+CO is produced in the reaction zone along with nontoxic slag.

The dwell time in the reaction zone is in the range of about 1 to 15 seconds, and preferably in the range of about 2 to 8 seconds. With substantially pure oxygen feed to the gas generator, the composition of the effluent gas from the gas generator in mole % dry basis may be as follows: $H_2$ 10 to 60, CO 20 to 60, $CO_2$ 5 to 60, $CH_4$ nil to 5, $H_2S$+COS nil to 5, $N_2$ nil to 5, and Ar nil to 1.5. With air feed to the gas generator, the composition of the generator effluent gas in mole % dry basis may be about as follows: $H_2$ 2 to 20, CO5 to 35, $CO_2$ 5 to 25, $CH_4$ nil to 2, $H_2S$+COS 0 to 3, $N_2$ 45 to 80, and Ar 0.5 to 1.5. Unconverted carbon, ash, or molten slag are contained in the effluent gas stream. Depending on the composition and use, the effluent gas stream is called synthesis gas, reducing gas, or fuel gas. For example, synthesis gas comprises mixtures of $H_2$+CO that can be used for chemical synthesis; reducing gas is rich in $H_2$+CO and is used in reducing reactions; and fuel gas comprises mixtures of $H_2$+CO and also includes $CH_4$. Coal has an ash content of about 5 to 30 wt. %. It was unexpectedly found that advantageously when coal is used as the aluminosilicate-containing material the ash from the coal will capture the noncombustible materials in the plastic materials, and the encapsulated material will flow from the reaction zone of the gas generator as substantially inert molten slag. Advantageously, in the extremely hot reducing atmosphere of the gasifier, the toxic elements in the inorganic matter in the solid carbonaceous plastic-containing material are captured by the noncombustible constituents in the aluminosilicate-containing material and converted into nontoxic nonleachable slag. This permits the nontoxic slag to be sold as a useful by-product. For example, the cooled slag may be ground or crushed to a small particle size e.g. less than ⅛" and used in road beds or building blocks.

The hot gaseous effluent stream from the reaction zone of the synthesis gas generator is quickly cooled below the reaction temperature to a temperature in the range of about 250° F. to 700° F. by direct quenching in water, or by indirect heat exchange for example with water to produce steam in a gas cooler. The gas stream may be cleaned and purified by conventional methods. For example, reference is made to coassigned U.S. Pat. No. 4,052,176, which is included herein by reference for removal of $H_2S$, COS, and $CO_2$. Advantageously, when gasifying plastics that contain halides such as polyvinylchloride, polytetrafluoroethylene, by partial oxidation, the halide is released as hydrogen halide (i.e. HCl, HF) and is scrubbed out of the synthesis gas with water containing ammonia or other basic materials. Plastics that contain bromine-containing fire retardants may be similarly treated. Reference is made to coassigned U.S. Pat. No. 4,468,376 which is incorporated herein by reference.

The following examples illustrate the subject invention and should not be construed as limiting the scope of the invention.

EXAMPLES

Example 1

4 tons per day of a mixture comprising several types of plastic that are found in automobiles including unfilled, filled, and reinforced plastics from the following resins: polyamide, polyurethane, polyvinylchloride, polypropylene, and others are shredded to a particle dimension of less than about ⅛" and mixed with 72.4 tons per day of water and 73 tons per day of bituminous coal having an ash content of about 10 wt. % and having an ash with an ash fusion temperature in a reducing atmosphere of below 2300° F. The coal is ground to a particle size so that 100% passes through ASTM E 11-70 Standard Sieve Designation 1.7 mm (Alternative No. 12) to produce a pumpable slurry having a maximum viscosity of 1000 cp when measured at 160° F. and a higher heating value of 8500 BTU/Lb. of slurry. The ultimate chemical analysis of a typical shredded mixture of plastics is shown in Table I. The chemical analysis of the ash in the mixture of plastics is shown in Table II.

TABLE I

Dry Analysis of Mixture of Plastics In Example 1.

| | Percent |
|---|---|
| C | 23.8 |
| H | 4.2 |
| N | 0.9 |
| S | 0.5 |
| O | 12.3 |
| Ash | 58.3 |

TABLE II

Chemical Analysis of the Ash Present In the Mixture of Plastics In Example 1.

| | Wt. % |
|---|---|
| $SiO_2$ | 33.20% |
| $Al_2O_3$ | 6.31% |
| $Fe_2O_3$ | 22.00% |
| CaO | 29.20% |
| MgO | 0.94% |
| $Na_2O$ | 1.27% |
| $K_2O$ | 0.43% |
| $TiO_2$ | 0.89% |
| $P_2O_3$ | 0.92% |
| $Cr_2O_3$ | 0.28% |
| ZnO | 2.31% |

TABLE II-continued

| Chemical Analysis of the Ash Present In the Mixture of Plastics In Example 1. | |
|---|---|
| | Wt. % |
| PbO | 0.09% |
| BaO | 0.80% |
| CuO | 0.89% |
| NiO | 0.00% |

The aforesaid pumpable aqueous slurry of plastics and coal is reacted with about 75 tons per day of oxygen gas by partial oxidation in a conventional freeflow noncatalytic gas generator at a temperature of about 2400° F. and a pressure of about 500 psig. Synthesis gas comprising $H_2$+CO is produced along with about 10 tons of slag. Upon cooling, the slag is a coarse, glassy nonleachable material. If however, the same mixture of plastics were fully combusted in air, the slag may contain toxic elements, e.g. chromium in a leachable form.

Example 2

50 tons per day of a mixture comprising several types of plastics that are found in the household including unfilled, filled, and foamed plastics, comprising polyethylene terephthalate, polyethylene, polyamide, polyurethane, polystyrene, polyvinylchloride, and polypropylene, are shredded to a particle dimension of about ⅛" and mixed with 35 tons per day of residual fuel oil, and 4 tons per day of coal ash having an ash fusion temperature in a reducing atmosphere of about 2310° F. The coal ash having a particle size of less than 12 mesh i.e. 1/16" is obtained by filtering stack gases from a complete combustion coal-fired boiler. The composition of the coal ash is shown in Table III. A pumpable slurry is produced having a higher heating value of about 16,000 BTU/Lb. of slurry. The ultimate chemical analysis of the shredded mixture of plastics is shown in Table IV. The chemical analysis of the ash in the mixture of plastics is shown in Table V.

TABLE III

| Chemical Anslysis of Coal Ash In Example 2. | |
|---|---|
| | Wt. % |
| $SiO_2$ | 54.51 |
| $Al_2O_3$ | 14.58 |
| $Fe_2O_3$ | 6.37 |
| MgO | 2.80 |
| CaO | 17.36 |
| $Na_2O$ | 3.13 |
| $K_2O$ | 0.12 |
| $TiO_2$ | 0.94 |
| $P_2O_3$ | 0.15 |
| MnO | 0.05 |

TABLE IV

| Ultimate Analysis of Shredded Mixture of Plastics In Example 2. | |
|---|---|
| | Percent |
| C | 82.3 |
| H | 10.2 |
| N | 0.0 |
| S | 0.1 |
| O | 5.6 |
| Ash | 1.8 |

TABLE V

| Chemical Analysis of the Ash Present In the Mixture of Plastics In Example 2. | |
|---|---|
| | Wt. % |
| $SiO_2$ | 30.63 |
| $Al_2O_3$ | 35.89 |
| $Fe_2O_3$ | 2.93 |
| CaO | 5.38 |
| MgO | 1.64 |
| $Na_2O$ | 4.55 |
| $K_2O$ | 0.82 |
| $TiO_2$ | 16.23 |
| $P_2O_3$ | 0.71 |
| $Cr_2O_3$ | 0.00 |
| ZnO | 0.62 |
| PbO | 0.10 |
| BaO | 0.19 |
| CuO | 0.07 |
| NiO | 0.07 |

The aforesaid pumpable slurry of plastics, and coal ash is reacted with about 8 tons per day of water temperature moderator and 93 tons per day of oxygen gas by partial oxidation in a conventional free-flow noncatalytic gas generator at a temperature of about 2400° F. and a pressure of about 500 psig. Synthesis gas comprising $H_2$+CO is produced along with about 5 tons of nonleachable slag.

The hydrogen content in the raw gas stream produced in Examples 1 and 2 may be increased by the well-known water gas shifting of the CO and $H_2O$. Acid-gases e.g. $CO_2$, $H_2S$ and COS may be removed from the raw product gas stream by conventional gas purification methods. The nontoxic nonleachable slag may be used for example as road fill. Advantageously, the toxic materials in the plastic, residual oil and coal ash, are captured in the slag in a nonleachable form and are thereby rendered nontoxic.

Other modifications and variations of the invention as hereinbefore set forth may be made without departing from the spirit and scope thereof, and therefore, only such limitations should be imposed on the invention as are indicated in the appended claims.

We claim:

1. A process for disposing of scrap plastic material comprising:

(1) mixing together the following materials to produce a pumpable slurry having a total solids content of about 30–70 weight % and a minimum HHV of about 4500 BTU/lb. of slurry:

(a) solid carbonaceous plastic-containing scrap material comprising a form thereof selected from the group consisting of sheets, extruded shapes, moldings, reinforced plastics, and foamed plastics, wherein said solid carbonaceous plastic-containing scrap material comprises at least about 25 weight percent of the pumpable slurry, and is formed into particulate solid carbonaceous plastic-containing scrap material having a maximum particle dimension of about ¼ inch and contains associated inorganic matter comprising at least one material selected from the group consisting of titania, talc, clays, alumina, glass, barium sulfate, and barium carbonate; compounds of Sn, Co, Mn, Pb, Cd, Cr, Cu, B; and steel, nickel, aluminum, brass and copper metal;

(b) aluminosilicate-containing material having noncombustible constituents that have an ash fusion temperature in a reducing atmosphere of less than about 2400° F.; wherein said aluminosilicate containing material is selected from the group consisting of coal, coal mine tailings, coal ash, illite clay, volcanic ash, and mixtures thereof; and wherein said aluminosilicate-containing material is characterized by the following:

A. a maximum particle size of ASTM E11-70 Sieve Designation Standard 1.70 mm;

B. a weight ratio of noncombustible constituents in said aluminosilicate-containing material to the inorganic matter in said particulate solid carbonaceous plastic-containing scrap material of at least 1 to 1; and C. a mole ratio $SiO_2/Al_2O_3$ in the range of about 1.5/1 to 20/1; and (c) a liquid slurrying medium selected from the group consisting of water, liquid hydrocarbonaceous fuel, and mixtures thereof; and (2) reacting said pumpable slurry from (1) with a free-oxygen containing gas and with or without a supplemental temperature moderator in free-flow unobstructed downflowing vertical partial oxidation gas generator in a reducing atmosphere at a temperature in the range of about 1800° F. to 3500° F., a weight ratio of $H_2O$ to carbon in the feed in the range of about 0.2 to 3.0, an atomic ratio of free-oxygen to carbon in the feed in the range of about 0.8 to 1.4, and a dwell time in the range of about 1 to 15 seconds to produce synthesis gas, reducing gas, or fuel gas; and wherein said inorganic matter in said particulate solid carbonaceous plastic-containing scrap material in (1)(a) is safely captured by said noncombustible constituents in said aluminosilicate-containing material from (1)(b) to produce nonhazardous slag.

2. The process of claim 1 wherein said noncombustible constituents in (1)(b) comprise the elements Al, Si and at least one element from the group consisting of Na, K, Mg, Ca and Fe.

3. The process of claim 1 wherein said aluminosilicate-containing material in (1)(b) has a total moles of oxides selected from the group consisting of Na, K, Mg, Ca, Fe, and mixtures thereof of about 0.9 to 3 times the moles of $Al_2O_3$; and a total amount of $Al_2O_3$, $SiO_2$, and the oxides of Na, K, Mg, Ca, and Fe that constitutes at least 90 wt. % of the total noncombustible inorganic components.

4. The process of claim 1 wherein the total solids content of said pumpable slurry in (1) with an aqueous slurrying medium in (1)(c) is in the range of about 30 to 70 wt. %; with a liquid hydrocarbonaceous fuel slurrying medium in (1)(c) the total solids content of said pumpable slurry in (1) is in the range of about 5 to 70 wt. %; and with a mixture of liquid hydrocarbonaceous fuel and water slurrying medium in (1)(c), the total solids content of said pumpable slurry in (1) is in the range of about 25 to 70 wt. %.

5. The process of claim 1 wherein said inorganic matter in (1)(a) is present in the amount of about a trace amount to 80 wt. % of the particulate solid carbonaceous plastic-containing scrap material; and said noncombustible constituents of the aluminosilicate-containing material in (1)(b) are present in the amount of about 5 to 100 wt. % of said aluminosilicate-containing material.

6. The process of claim 1 wherein about 0.1 to 60 wt. % of the particulate solid carbonaceous plastic-containing scrap material in (1)(a) comprises associated inorganic matter; the aluminosilicate-containing material in (1)(b) is coal; and the slurrying medium in (1)(c) comprises water with or without liquid hydrocarbonaceous fuel.

7. The process of claim 1 wherein said solid carbonaceous plastic-containing scrap material is shredded in a separate step to form the particulate scrap and said aluminosilicate-containing material is ground in a separate step.

8. The process of claim 1 provided with the step of introducing into said pumpable slurry in (1) a supplemental amount of a particulate solid carbonaceous plastic-containing material that is substantially free from associated inorganic matter.

9. The process of claim 1 wherein said pumpable slurry in (1) is an aqueous slurry and ammonium lignosulfonate is introduced into said slurry in the amount of about 0.01 to 3.0 wt. % of said slurry.

10. The process of claim 1 wherein said particulate solid carbonaceous plastic-containing scrap material in (1)(a) includes a halogen-containing plastic material and the product gas stream in (2) contains a hydrogen halide; and provided with the step of scrubbing said product gas stream with water containing ammonia or other basic material to remove said hydrogen halide.

11. The process of claim 10 wherein said halogen-containing plastic material is polyvinylchloride and/or polytetrafluoroethylene and said hydrogen halide is HCl if polyvinylchloride is present and/or HF if polytetrafluoroethylene is present.

12. A process for disposing of scrap plastic material comprising:

(1) mixing together the following materials to produce a pumpable slurry having a total solids content in the range of about 3.0 to 70 weight % and a minimum HHV of about 4500 BTU per lb. of slurry:

(a) particulate solid carbonaceous thermoplastic or thermosetting plastic-containing scrap material prepared from a form of plastics selected from the group consisting of sheets, extruded shapes, moldings, reinforced plastics, and foamed plastics, wherein said plastic-containing scrap material comprises at least about 25 weight % of the pumpable slurry, and has a maximum particle dimension of about 3 inch, and contains at least one inorganic ingredient in the amount of about 0.1 to 60 weight % of said plastic-containing material; and said inorganic ingredient is selected from the group consisting of: titania, talc, clays, alumina, glass, barium sulfate and carbonates, compounds of Sn, Co, Mn, Pb, Cd, Cr, Cu, B; and steel, nickel, aluminum, brass and copper metal;

(b) bituminous coal con mining inorganic ash having an ash fusion temperature in a reducing atmosphere of less than about 2400° F. and said ash constituting about 5 to 30 weight % of said coal; wherein the weight ratio of said ash in (b) to inorganic ingredient in (a) is at least 1;

(c) a liquid slurrying medium selected from the group consisting of water, liquid hydrocarbonaceous fuel, and mixtures thereof;

(2) introducing the pumpable slurry from (1) into the reaction zone of a partial oxidation gas generator by way of the intermediate annular passage of a multi-passage annular burner comprising a central conduit, an intermediate coaxial annular passage, and an outer coaxial annular passage, and passing a stream of free-oxygen containing gas through said central conduit and outer annular passage; and (3) reacting said pumpable slurry with said free-oxygen containing gas in said partial oxidation gas generator having a reducing atmosphere at a temperature of about 1800° F. to 3500° F., a weight ratio of $H_2O$ to carbon in the feed of about 0.2 to 3.0, an atomic ratio of free-oxygen to carbon in the feed of about 0.8 to 1.4, and a dwell time of about 1 to 15 seconds to produce a gas selected from the group consisting of synthesis gas, reducing gas, fuel gas, and mixtures thereof; and nonhazardous slag.

* * * * *